US007322430B2

(12) United States Patent
Littlely

(10) Patent No.: US 7,322,430 B2
(45) Date of Patent: Jan. 29, 2008

(54) APPARATUS AND METHOD FOR REDUCING REQUIRED TORQUE

(75) Inventor: Keith Littlely, Perth (AU)

(73) Assignee: Sandvik Mining and Construction Australia Pty Limited, Eagle Farm (AU)

( * ) Notice: Subject to any disclaimer, the term of this patent is extended or adjusted under 35 U.S.C. 154(b) by 106 days.

(21) Appl. No.: 10/492,742

(22) PCT Filed: Oct. 15, 2002

(86) PCT No.: PCT/AU02/01400

§ 371 (c)(1),
(2), (4) Date: Aug. 2, 2004

(87) PCT Pub. No.: WO03/033858

PCT Pub. Date: Apr. 24, 2003

(65) Prior Publication Data

US 2005/0067192 A1 Mar. 31, 2005

(30) Foreign Application Priority Data

Oct. 15, 2001 (AU) ..... PR8255

(51) Int. Cl.
*E21B 1/00* (2006.01)

(52) U.S. Cl. ..... 175/51; 166/377

(58) Field of Classification Search ..... 166/377, 166/77.51; 175/51, 90

See application file for complete search history.

(56) References Cited

U.S. PATENT DOCUMENTS

| | | | | |
|---|---|---|---|---|
| 2,566,999 | A * | 9/1951 | Stone | 81/464 |
| 3,446,284 | A | 5/1969 | Dyer et al. | |
| 3,771,389 | A | 11/1973 | Coyne | |
| 3,980,143 | A | 9/1976 | Swartz et al. | |
| 5,138,915 | A * | 8/1992 | Doll | 81/463 |
| 2001/0017067 | A1 * | 8/2001 | Collins et al. | 81/57.39 |

* cited by examiner

*Primary Examiner*—William P Neuder
(74) *Attorney, Agent, or Firm*—Madison & Austin

(57) ABSTRACT

A method of reducing the torque required to provide relative rotation of two connected members includes providing impacts at or adjacent the connection between the two members at a rate of at least two impacts per second. An apparatus for reducing the torque required to provide relative rotation of two connected members includes an impact member adapted to provide an impact to at least one of the connected members, a driver for driving the impact member, wherein the driver is operable to cause the impact member to automatically and repeatedly impact upon the at least one member.

18 Claims, 2 Drawing Sheets

APPARATUS AND METHOD FOR REDUCING REQUIRED TORQUE

FIELD OF THE INVENTION

The present invention relates to an apparatus and method for reducing the torque required to provide relative rotation of two connected members, and especially but not exclusively to an apparatus and method for facilitating disconnecting of drill rods.

BACKGROUND OF THE INVENTION

Drill rods are lengths of hollow pipe which typically have a male thread at one end and a female thread at the other end. Drill rods range in size up to about ten meters long and a plurality of drill rods are assembled in forming a drill string by engaging the male thread of an upper drill rod with the female thread of an adjacent lower drill rod or vice versa. The lower end of a drill string culminates in a cutting head which drills through the ground when rotated. In operation, the upper end of the drill string is rotated by a drive mechanism mounted on a drilling rig from which the drill string downwardly projects. A drill string may project vertically from a drill rig or at a desired angle to vertical. Drill strings are commonly many hundreds of meters long and can be thousands of meters long. Rotation of the cutting head by action of the drive mechanism therefore necessitates that drill rods are rigidly connected together.

The making (connecting) of drill rod joints is typically performed manually by an operator locating the appropriately threaded end of a drill rod to be added to the drill string into the mating thread of the uppermost drill rod in the drill string so far assembled. The drill rod to be added to the drill string is then rotated into threaded engagement with the adjacent drill rod below it using a pair of stillsons. The drill string which has been lengthened by connection of the drill rod is then rotated by the drive mechanism until it moves a further distance into the ground, with a further drill rod then connected and so on. The operator must exert considerable force on the stillsons to connect the drill rods sufficiently firmly. The breaking (disconnecting) of drill rods from a drill string (tripping the string) is essentially the reverse of the making procedure, except that the torque required to disconnect rods is generally even greater than that required to connect them, so several operators using stillsons one or more meters in length may be required. Connections between drill rods may tighten during use due to the torque applied to the drill string and/or to any heating or deformation of the drill rods which may occur in use.

The breaking of drill strings is therefore inherently a particularly dangerous operation, with injuries to operators an ever present possibility. For example, severe injury can result if the drill string drive mechanism is accidentally actuated whilst a pair of stillsons are attached to a drill rod, and it is not uncommon for operators exerting considerable effort in forcing stillsons to slip and fall. It is therefore desirable to provide an apparatus which facilitates the disconnection of two drill rods.

SUMMARY OF THE INVENTION

According to a first aspect of the present invention, there is provided an apparatus for reducing the torque required to provide relative rotation of two connected members comprising:

an impact member adapted to provide an impact to at least one of the connected members;

driving means for driving the impact member, wherein said driving means is operable to cause the impact member to automatically and repeatedly impact upon said at least one member.

Preferably, said apparatus is adapted for use on connected members which are drill rods.

Preferably, said impact member reciprocates in order to repeatedly impact upon at least one member.

The impact member may impact upon said at least one member directly, or the impact may be via an intermediary.

If the impact is via an intermediary, said intermediary is preferably configured so as to help prevent the member from being damaged by the impacts.

Preferably, said impact member impacts said at least one member at a rate of at least 2 impacts per second, more preferably at a rate of at least 10 or at least 20 impacts per second and, most preferably, at a rate of about 30 impacts per second.

Preferably, each impact of the impact member has an energy of at least 7.5 joules.

Preferably, each impact of the impact member has an energy of between about 25 and about 200 joules, and most preferably of approximately 75 joules.

Preferably, the impacts are provided substantially radially with respect to the connected elements.

Preferably, in use, said impact member moves in a substantially straight line along an axis which intersects a central axis of the connected members.

Preferably, said driving means comprises a hydraulic or a pneumatic system.

There may be provided biasing means for biasing the impact member towards a position in which said impact member is to be retained when said apparatus is not in operation.

The biasing means may be operatively mechanically coupled to the impact member in order to bias said impact member, but may be decoupled from said impact member so as to be operatively decoupled when the impact member is driven by the driving means.

The coupling and decoupling of the bias means and the impact member may be effected automatically according to whether or not the apparatus is in a working configuration with a connection member.

Preferably, said apparatus includes a locating member adapted to engage a connected member in order to locate the apparatus in a predetermined position relative thereto.

The locating member may be moveable, relative to the rest of the apparatus, between a first position in which it is in engagement with a connected member, and a second position in which a connected member is not engaged.

The position of the locating member may determine whether the bias means is operatively coupled to the impact member.

Preferably, the apparatus includes a mounting portion for mounting said apparatus to a mounting member for supporting the apparatus, in use, relative to the at least one connected member.

Preferably, the apparatus is adapted to be deployed relative to a connected member by pivoting relative to the mounting member.

According to a second aspect of the present invention, there is provided a method of reducing the torque required to provide relative rotation of two connected members comprising the step of:

providing impacts at or adjacent the connection between the two members at a rate of at least two impacts per second.

Preferably, the impacts are provided at the same time as torque is applied to said connection.

Preferably, the step of providing impacts is performed by use of an impact member which is not manually driven. Most preferably, the impacting means is hydraulically or pneumatically driven.

Preferably, the rate at which impacts are provided is at least ten per second, more preferably at least 20 per second, and most preferably about 30 impacts per second.

Preferably, the energy of each impact is at least 7.5 joules, and more preferably the energy of each impact is between about 25 and 200 joules, and most preferably is approximately 75 joules.

The method may be applied to reducing the torque required to provide relative rotation of connected members which are drill rods.

Preferably, the impacts are provided substantially radially with respect to the connected elements.

Preferably, the impacts are provided by one or more impact members at least one of which, immediately before impact, operates so that a surface which impacts at least one of the connected members moves in the direction of an axis which intersects an axis of at least one of the connected members.

Preferably, said method includes use of an apparatus in accordance with a first aspect of the present invention.

According to a third aspect of the present invention, there is provided a method of providing relative rotation of two drill rods of a drill string connected to a drill string driving means, said method comprising the steps of:

fixing a first drill rod, which is further from the drill string driving means than a second drill rod, against rotation;

providing impacts at or adjacent the connection between the first and second drill rods, said impacts being provided at a rate of at least two per second;

applying torque to the second drill rod, in a desired direction, by operation of the drill string driving means, and thereby effecting relative rotation of the first and second drill rods.

Preferably, the step of providing impacts is performed by use of an impact member which is not manually driven.

Preferably, the impact member is hydraulically or pneumatically driven.

Preferably, the rate at which impacts are provided is at least ten per second, more preferably at least 20 per second, and most preferably about 30 impacts per second.

Preferably, the energy of each impact is at least 7.5 joules, more preferably the energy of each impact is between 20 and 200 joules, and most preferably the energy of each impact is approximately 75 joules.

Preferably, the impacts are provided substantially radially with respect to the drill rods.

Preferably, the impacts are provided by one or more impact members at least one of which, immediately before impact, moves in the direction of an axis which intersects an axis of at least one of the drill rods.

Preferably, said method includes use of apparatus in accordance with a first aspect of the present invention.

Preferably, said apparatus is mounted on a mounting member in the vicinity of the drill string.

Preferably, said mounting member is mounted on a drill rig.

Preferably, said apparatus is mounted so as to be deployable from an inactive position in which it is spaced apart from the drill rods, to an active position, in which the impact member is deployed close to the drill rods.

Preferably, the apparatus is deployed by pivoting about the mounting member.

The apparatus may be deployable manually. Alternatively, deployment of the apparatus may be achieved using a powered system.

BRIEF DESCRIPTION OF THE DRAWINGS

Embodiments of the present invention will now be described, by way of example only, with reference to the drawings in which.

DETAILED DESCRIPTION OF THE DRAWINGS

Figure 1:
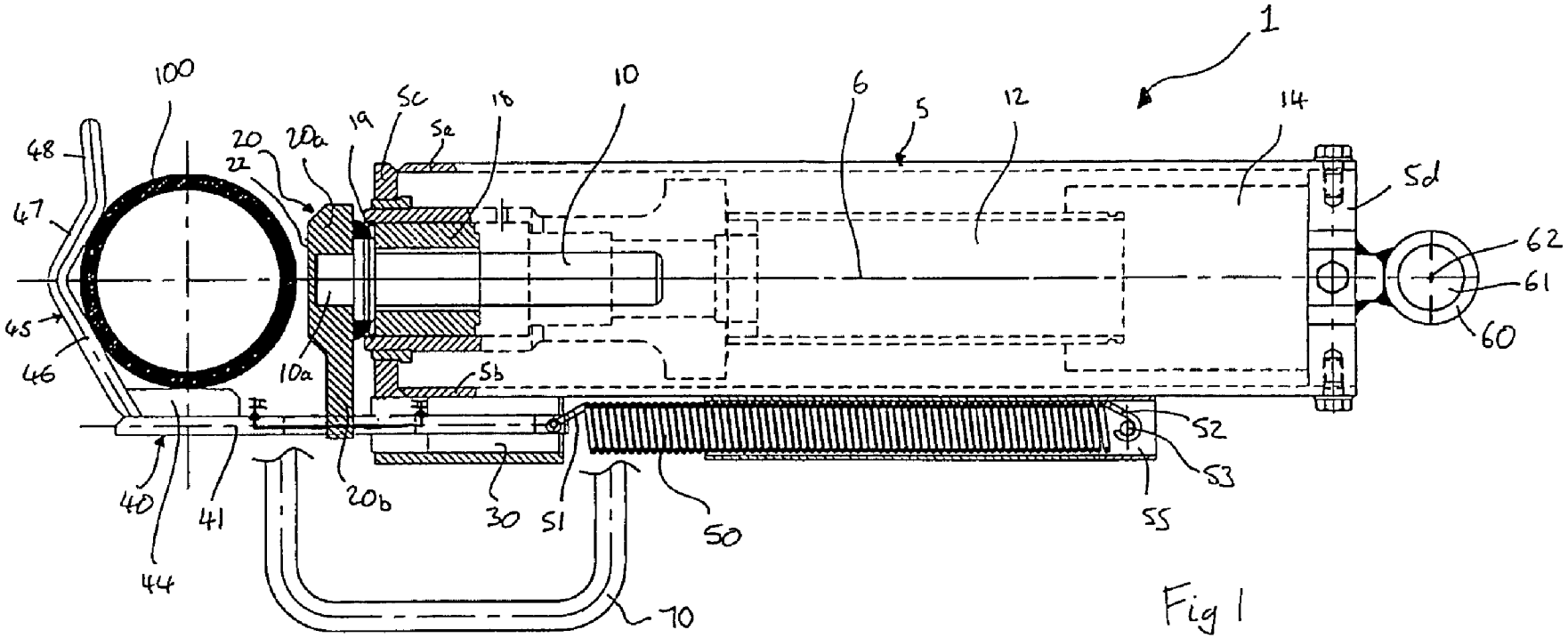
FIG. 1 is a horizontal partial cross section of an embodiment of apparatus in accordance with the first aspect of the present invention and a drill rod.

With reference to FIG. 1, an embodiment of apparatus, generally designated 1, for reducing the torque required to provide relative rotation of two connected members in the form of drill rods, comprises a metal casing 5 from which partially protrudes an impact member 10 which can be driven to reciprocate by driving means in the form of a hydraulic system 12,14 which has a reservoir outside the casing 5 and connected to the hydraulic system 12,14 by a hose (not shown). The operation and structure of a hydraulic system to induce rapid reciprocating motion in a member used to impact another object, such as in a hydraulic jack hammer, will be understood by the person skilled in the art and will not be described in detail herein.

The casing 5 is generally square in cross section, has an axial length which is large compared to its cross sectional extent, and has a longitudinal central axis designated 6 in FIG. 1. The casing 5 is thus generally cuboid and has first and second rectangular side walls 5*a*,5*b*, upper and lower rectangular walls (not shown) and substantially square front and rear end walls 5*c*,5*d*. The impact member 10 is coaxial with the casing 5 and has a first end 10*a* which protrudes from the front wall 5*c* of casing 5, and a second end 10*b* which is retained inside the casing in mechanical connection with the hydraulic system 12,14. The impact member 10 is radially retained by a cylindrical bush 18 through which the impact member 10 can slide axially. The bush 18 is retained within, and coaxial with, the casing 5 and is also, therefore, coaxial with the impact member 10. A retaining ring 19 is provided where the bush 18 reaches the front end wall 5*c* of the casing 5, in order to retain the bush 18.

The first end of the impact member 10 is embedded in, and attached to (preferably by welding), a head member 20 which acts as an intermediary between the impact member 10 and a drill rod 100 which the apparatus acts upon. The head member 20 has a main portion 20*a* which is generally coaxial with the impact member 10, and is polygonal (preferably circular, hexagonal or octagonal) in radial cross section. At the axial end of the main portion 20*a* which is further from the casing 5 is an impact surface 22. A radial extension 20*b* of the head member, which is axially closer to the casing 5 than is the impact surface 22, extends radially and horizontally away from the main body 20*a* of the head member 20 and past the second side wall 5*b* of the casing 5.

Figure 2:
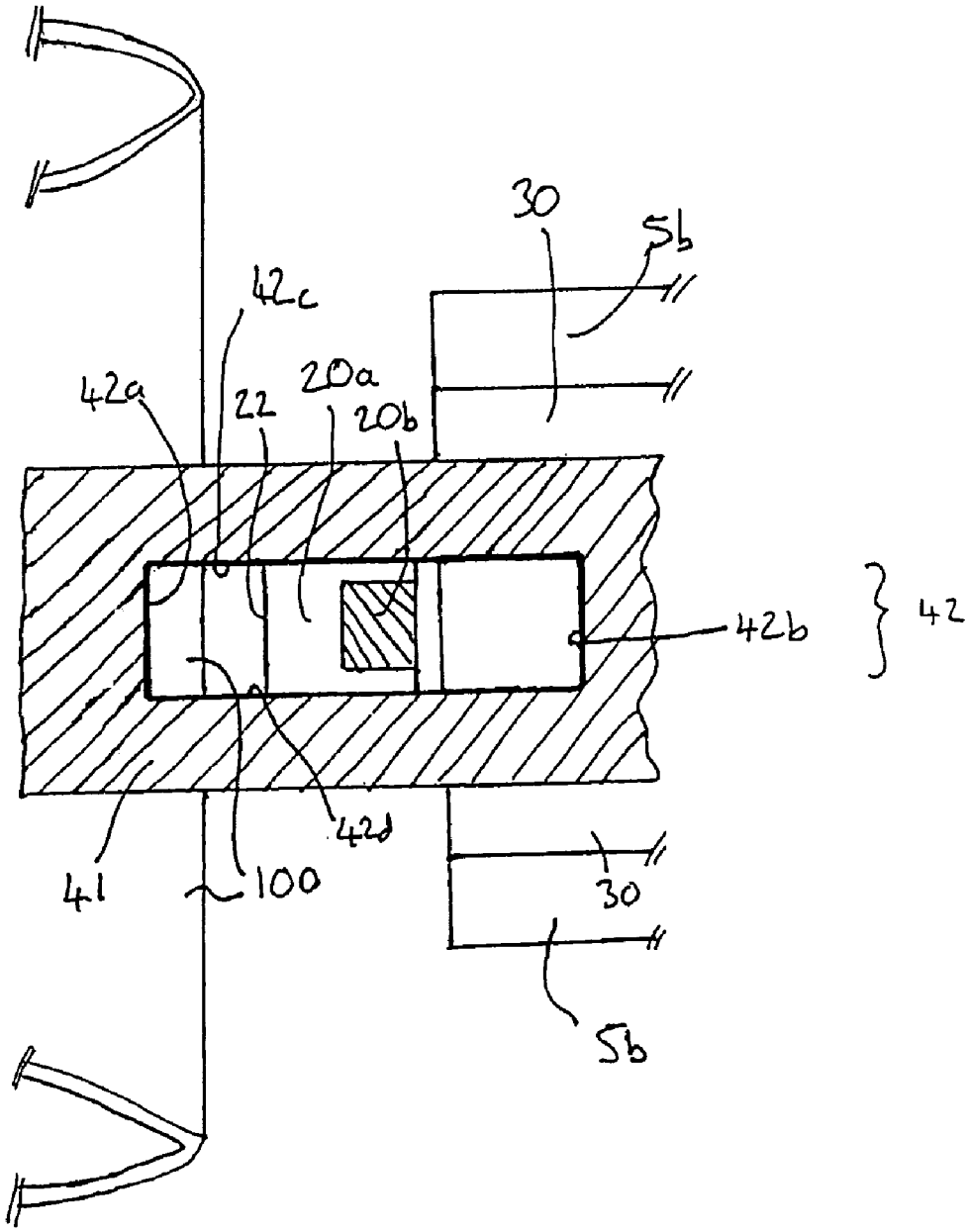
FIG. 2 is a cross sectional side view, on II-II of FIG. 1 showing a detail of two cooperating elements of the embodiment.

Attached to the second side wall 5*b* and extending axially back from the front end wall 5*c* is a retaining block 30 which retains a drill rod clip 40 slidably therein. The drill rod clip 40 (part of which is also shown in FIG. 2) serves as a locating member to help locate the apparatus 1 relative to the drill rod 100. The drill rod clip 40 includes a forwardly extending portion 41, which extends forwardly parallel to the axis of the casing 5, and which is retained by, but can slide axially through, the retaining block 30. At the forward-most end of the forwardly extending portion 41 on the axial side thereof, is a drill rod positioning pad 44. Extending from the forward-most end of the forwardly extending portion 41, a drill rod engaging portion 45 of the drill rod clip 40 comprises a first part 46 which extends from a first end thereof at which it is connected to the forwardly extending portion 41, both forwardly and to the axis 6 of the casing 5, where it intersects the axis 6 at a second end of said first part 46. The drill rod engaging portion 45 further includes a second part 47 which extends from the second end of the first part 46, both rearwardly and away from the axis 6 of the casing before it curves again forwardly to form a third part 48 of the drill rod engaging portion 45 of the drill rod clip 40.

The drill rod clip 40 is biased in the rearward direction of the casing 5, by biasing means in the form of a coil spring 50. The coil spring 50 is aligned along the second side wall 5*b* of the casing 5, parallel to the axis 6, and all but a forward part thereof is housed in a spring housing 55, which is rigidly attached to the second side wall 5*b*. The spring 50 is attached at a forward first end 51 thereof to the rearmost portion of the forwardly extending portion 41 of the drill rod clip 40. The coil spring 50 is attached at a rearmost second end 52 thereof to a pin 53 which is fixed to a rear portion of the spring housing 55.

As can be seen in FIG. 2, the forwardly extending portion 41 of the drill rod clip 40 is provided with a longitudinally extending rectangular aperture 42 which has a forward-most edge 42*a*, a rear-most edge 42*b* and upper and lower edges 42*c*,42*d*. The radial extension 20*b* extends through the aperture 42. As shown in FIGS. 1 and 2, the drill rod clip 40 and the aperture 42 are in a position which corresponds to the drill rod clip 40 being in contact with a drill rod 100, and in this configuration they do not have any contact with the radial extension 20*b* irrespective of the position of the impact member 10. When a drill rod 100 is not engaged by the drill rod clip 40, the drill rod clip 40 is moved in a rearward direction by the spring 50 so the front edge 42*a* of the aperture 42 engages the radial extension 20*b*. The front edge 42*a* provides a rearward bias force on the radial extension 20*b* and thus operatively couples the spring 50 and the impact member 10. This biases the impact member 10 into its fully retracted position, and thus causes hydraulic fluid in the hydraulic system 12,14 within the casing 5 to be returned to a fluid reservoir (not shown), located outside the casing 5.

At the rear-most end of the casing 5, rigidly attached to the rear wall 5*d* of the casing, preferably by welding, is a cylindrical mounting bush 60 which has a cylindrical bore 61 with, in use, a substantially vertical central axis 62 which is generally perpendicular to the axis 6 of the casing 5. This enables the casing to be mounted to a vertical mounting rod (not shown) and pivoted about the mounting rod in a generally horizontal plane.

Attached to the casing 5 is a handle 70, shown schematically in FIG. 1. The position of the handle is such that it can be easily reached and operated by an operator located on the second side wall 5*b* side of the casing 5. Thus the forwardly extending portion 41 of the rod clip 40 is, in use, located between the operator and the rod 100, head member 20, and impact member 10, as a safety measure.

In use the apparatus is attached to a drilling rig (not shown) by mounting via the cylindrical boss 60 (which constitutes a mounting portion) to a mounting member preferably including a vertical mounting rod. In the preferred embodiment, the mounting member is located so that the distance between the central axis of the cylindrical boss 60 and the central axis of the drill rod to be acted upon, is equal to the distance between the axis 62 of the cylindrical boss 60 and the impact surface 22 when the impact member 10 is in its fully retracted position, plus half the outside diameter of the drill rod plus 6 mm.

When the apparatus 1 is mounted to the mounting rod via the cylindrical bush 60, it can be pivoted about the mounting member, in a substantially horizontal plane, between an active position in which the apparatus 1 extends between the mounting member and the drill rod 100 and an inactive position in which the apparatus 1 is angularly displaced from the active position to a convenient position in which it does not contact the drill rod 100.

In use, to disconnect two drill rods, the drill string is raised or lowered to a position where a connection between the two drill rods is substantially horizontally level with the apparatus 1. The drill string is then locked off (prevented from rotation), normally by a spanner at a point horizontally below the level of the apparatus 1.

In order to move the apparatus 1 from the inactive position to the active position, an operator pivots the apparatus about the mounting rod by pushing on the handle 70. The first part of the apparatus to contact the drill rod 100 will be the third part 48 of the drill rod engaging portion of the drill rod clip 40, which will be in its rear-most position due to the biasing effect of the spring 50.

When the third part 48 contacts the drill rod 100, the application of force by the operator, in combination with the previously explained orientation of the third part 48 will cause the third part 48 and thus the drill rod clip 40 to be forced in the forward direction against the biasing force of the spring. As the apparatus 1 is rotated further about the mounting rod, the drill rod is contacted by the first and second parts 46,47 of the drill rod engaging member 45 and by the positioning pad 42, and the apparatus 1 is thus located in a predetermined position with respect to the drill rod 100. The drill rod clip 40 is retained by the drill rod 100 in an extended position.

In order to reduce the torque required to rotate the two drill rods relative to each other, the hydraulic system is then operated in order to cause the impact member 10 to reciprocate rapidly. This causes repeated impacts of the face surface 22 of the head member 20 against the outer surface of at least one of the two drill rods 100 at or close to the connection between the two drill rods. In this embodiment, a blow rate of 1400 blows per minute is used with an energy for each blow of about 75 joules. A variation with a blow rate of 1800 blows per minute (and similar energy per blow) has been found to be even more effective. These parameters have been found to be suitable for drill rods with an outside diameter of approximately 4 inches (approximately 10 cm) and have been found to reduce the torque required to separate two drill rods of this type from about 16000 Nm down to about 3000 to 4000 Nm. It is believed that the repeated forceful impacts help to break down the static friction between the mated threads of the drill rods. Typically, this substantially reduced amount of torque can be supplied by the drill string driving means, which is generally a motor at the drill string top, but could be any apparatus used to operate the drill string by rotating it. In a preferred embodiment, it is therefore possible to trip the string using the torque supplied by the drilling motor and without requiring force to be applied manually by, for example, operators with stillsons.

This clearly provides a considerable advantage over methods previously used to trip the string, since it avoids the dangers associated with operators exerting their full physical strength and can also avoid the problems of stillsons being used outside their rated capacities, which frequently occurs in the tripping of strings. The apparatus 1 is typically operated for approximately 10 to 20 seconds while torque is applied to the connection. An angular movement between the drill rods of about 20 degrees is normally sufficient to enable further relative rotation even once the apparatus 1 ceases to operate.

When the required degree of relative rotation between the connected drill rods has been provided, the apparatus can be pivoted back to its inactive position about the mounting rod. As the apparatus 1 is moved away from the drill rod 100, the drill rod clip 40 is forced forwardly by the engagement of the second part 47 on the drill rod 100. Then, when the drill rod clip 40 is clear of the drill rod 100, the drill rod clip 40 is retracted by the biasing action of the spring 50 to its rear-most, retracted, position. As the drill rod clip 40 is retracted, the forward-most edge 42*a* of the aperture 42 engages the radial extension 20*b* and the impact member 10 is thus forced back to its retracted position, thereby returning hydraulic fluid to the reservoir as described above.

The described preferred embodiment thus provides a method of greatly reducing the torque required to provide relative rotation of two members in the form of drill rods 100. The apparatus, when mounted as described, is easy to deploy into its active position by merely being pushed into place by an operator and is easy to deploy back to its inactive position by being pulled by an operator away from the drill rod 100. When not deployed the apparatus is effectively re-set back to a ready configuration by the biasing action of the spring 50. The embodiment described is approximately 46 cm in axial length from the axis 62 of the cylindrical bush 60 to the impact surface 22 when the impact member 10 is in its retracted position. The hydraulic system utilises a flow rate of about 32 litres and provides a maximum axial displacement of the impact member of about 5 cm.

It is envisaged that in addition to assisting in the breaking of drill rod connections such an apparatus could be used to assist in the making of connections, allowing a given torque (applied, for example, by the drilling motor) to provide a tighter connection than has previously been possible.

Variations of the embodiment may be of different sizes in order to operate upon connecting members of different types and/or sizes. Although specific blow rates and energy per blow are described above, the values given are by way of example, and a wide range of values for these parameters could be beneficially used. However, a blow rate of at least 2 per second is preferred although to be most effective this relatively slow blow rate requires higher energy per impact than is required at faster blow rates. Blow rates of at least 10 per second and more preferably of approximately 20 per second or most preferably of about 30 per second are considered more preferable. An impact energy of at least 7.5 joules is preferred, and for typical drill rods impact energy of between about 25 and 200 joules per blow is preferred, although clearly different impact energies will be suitable for different types of connected member. An impact energy of about 75 joules per impact at a blow rate of 30 per second (1800 blows per minute) is effective for 4 inch (10 cm) diameter drill rods, but an impact energy of about 200 joules per impact (at the same blow rate) would be more effective for typical 8 inch (20 cm) bore drill rods. Even higher impact energies might be desirable for other applications.

Although the preferred embodiment is deployed by pivoting horizontally about a mounting rod, other modes of deployment such as being moved axially into place in a direction radial to the connected member are envisaged. While it is preferable to apply impacts at the same time as applying torque to the connection between two connection members it is envisaged that applying a number of impacts before applying torque could provide some reduction in the amount of torque required. In addition, different driving means to power the apparatus may be provided, (for example, an electric motor) although hydraulics or pneumatics are presently preferred and are convenient since drilling rigs are generally operated with a compressor in the vicinity. Furthermore, although it is preferred to have an impact member which reciprocates in an axial direction so as to move towards and away from an axis of the connected member, other forms of movement or orientation for repeatedly impacting the connected member could be used, and although not preferred, many such variations will be evident to the skilled addressee.

In the above disclosed instructions for fitting the apparatus 1 using a mounting rod, a margin of error of 6 mm is provided so that as the apparatus is deployed a gap of 6 mm is provided between the drill rod 100 and the impact face 22 of the head member 20. The gap of 6 mm is not required for proper functioning of the apparatus but is desirable in order to allow easy deployment of the apparatus 1. An embodiment in which the impact member 10 (or head member 20) contacts a connected member when the apparatus is deployed, and then remains in contact with the connected member as it provides impulses or impacts is considered to fall within the scope of the invention. The third part 48 of the drill rod clip 40 may be provided with additional means such as a roller to facilitate engagement with the pipe and extension of the drill rod clip 40. An extendible drill rod clip 40 is not essential for locating the apparatus with respect to the drill rod 100 but provides a convenient means of providing a biasing force to the impact member 10 when a drill rod is not engaged, while isolating the biasing means from the impact member 10 when a drill rod is engaged, that is, when the apparatus is being operated. It is desirable to isolate the bias means from the impact member 10 when the impact member 10 is reciprocating because the force and frequency of reciprocation of the impact member 10 would typically damage a biasing means such as a spring very quickly. Of course, biasing means other than a spring could be used, for example, a strip or chord of a suitable resilient material, a piston arrangement or any other means of applying a suitable force.

In an alternative embodiment, a locating member to help locate the apparatus relative to a connected member does not move axially relative to the apparatus, but is effectively a forwardly projecting member rigidly attached to the casing of the apparatus. Except for the rigid attachment to the casing, such a locating member may correspond generally to the forwardly extending portion 41 of the drill rod clip 40 shown in FIG. 1 and may include a positioning pad (but need not include a part corresponding to the first part 46 of the drill rod engaging portion 45 of FIG. 1, and does not include parts corresponding to the second and third parts 47, 48 of the drill rod engaging portion 45 of FIG. 1). The apparatus of this embodiment is preferably mounted so that it can be pivotally deployed from an inactive position spaced from the connected members to an active position using a hydraulic or pneumatic (or other powered) system, rather than manually, since this may provide safety advantages and allows the deployment system to retain the apparatus in the desired position during operation. Pivotal deployment is preferred (as described above) but various ways in which the apparatus can be deployed will be apparent to the skilled person. In this embodiment, (as no biasing spring is provided) the impact member may be returned to its fully retracted position by its contact with the connected member (or drill rod) as the apparatus is deployed. This is facilitated if the connected member is circular in cross-section, but the shape and/or amount of travel of the impact member (and/or head member) may be provided in order to facilitate this.

Head members may be selected to provide a combination of hardness and size of impact surface to avoid the impacts unduly damaging the connection member or drill rods. (of course, it should be fully appreciated that the invention is applicable to connected members other than drill rods.) The connection between drill rods typically includes complementary male and female helical threaded portions on the drill rod ends which are to be connected. Drill rods could be provided in which each drill rod has a male portion at each end or a female portion at each end so that in a drill string, drill rods with male ends alternate with drill rods with female ends. The invention is, of course, suitable for use with such drill rods. The invention may also be applicable for use with drill rods or connected members which do not include helical threads, such as those which use some other connection configuration which requires relative rotation of two members to connect or disconnect them.

An embodiment is also envisaged in which a connection member or a drill rod is impacted from more than one (preferably radial) direction while torque is applied thereto.

Two impacting positions may be provided on diametrically opposed sides of the connected members, or three or more may be provided spaced circumferentially around the connected members. The impacts in different positions could be in phase, out of phase, or provided sequentially, such as progressively about the cross sectional circumference of at least one of the connected members. Two or more units of the apparatus in accordance with the preferred embodiment could be used, or an alternative arrangement employed. Alternatively, multiple impacting positions could be axially spaced along the connected members. For drill rods of about 10 cm outside diameter a single impact position works effectively and is preferred for reasons of convenience and economy, but multiple impact positions could be favourably employed for other sizes of connected elements.

The words "comprising", "having", and "including" should be interpreted in an inclusive sense, meaning that additional features may also be added.

It is to be understood that, if any prior art publication is referred to herein, such reference does not constitute an admission that the publication forms a part of the common general knowledge in the art, in Australia or in any other country.

Variations and modifications can be made in respect of the invention described above.

The invention claimed is:

1. Apparatus for reducing the torque required to provide relative rotation of two connected members comprising:

an impact member adapted to provide an impact to at least one of the connected members;

driving means for driving the impact member, wherein said driving means is operable to cause the impact member to automatically and repeatedly impact upon said at least one member: and wherein the apparatus is configured so that in use the impacts do not impart substantial torque on said connected member wherein there is provided biasing means for biasing the impact member towards a position in which said impact member is to be retained when said apparatus is not in operation, wherein the biasing means is operatively mechanically coupled to the impact member in order to bias said impact member, but may be decoupled from said impact member so as to be operatively decoupled when the impact member is driven by the driving means.

2. Apparatus as claimed in claim 1, wherein said coupling and decoupling of the bias means and the impact member is effected automatically according to whether or not the apparatus is in a working configuration with a connection member.

3. Apparatus as claimed in claim 1, wherein said apparatus includes a locating member adapted to engage a connected member in order to locate the apparatus in a predetermined position relative thereto, wherein said locating member is moveable, relative to the rest of the apparatus, between the first position in which it is in engagement with a connected member, and a second position in which a connected member is not engaged, wherein the position of the locating member determines whether the bias means is operatively coupled to the impact member.

4. A method of providing relative rotation of two drill rods of a drill string connected to a drill string driving means, said method comprising the steps of:

fixing a first drill rod, which is further from the drill string driving means than a second drill rod, against rotation;

providing impacts at or adjacent the connection between the first and second drill rods, said impacts being provided at a rate of at least two per second; and applying torque to the second drill rod, in a desired direction, by operation of the drill string driving means, and thereby effecting relative rotation of the first and second drill rods.

5. A method as claimed in claim 4, wherein the step of providing impacts is performed by use of an impact member which is not manually driven.

6. A method as claimed in claim 5, wherein the impact member is hydraulically or pneumatically driven.

7. A method as claimed in claim 4, wherein the rate at which impacts are provided is at least ten per second.

8. A method as claimed in claim 7, wherein the rate at which impacts are provided is at least 20 per second.

9. A method as claimed in claim 4, wherein the energy of each impact is at least 7.5 joules.

10. A method as claimed in claim 9, wherein the energy of each impact is between 20 and 200 joules.

11. A method as claimed in claim 4, wherein the impacts are provided by one or more impact members at least one of which, immediately before impact, moves in the direction of an axis which intersects an axis of at least one of the drill rods.

12. A method as claimed in claim 4, wherein the impacts are provided substantially radially with respect to the drill rods.

13. A method as claimed in claim 4, wherein said method includes use of apparatus for reducing the torque required to provide relative rotation of two connected members comprising:

an impact member adapted to provide an impact to at least one of the connected members; and driving means for driving the impact member, wherein said driving means is operable to cause the impact member to automatically and repeatedly impact upon said at least one member.

14. A method as claimed in claim 13, wherein said apparatus is mounted on a mounting member in the vicinity of the drill string.

15. A method as claimed in claim 13, wherein said mounting member is mounted on a drill rig.

16. A method as claimed in claim 14, wherein said apparatus is mounted so as to be deployable from an inactive position in which it is spaced apart from the drill rods, to an active position, in which the impact member is deployed close to the drill rods.

17. A method as claimed in claim 16, wherein the apparatus is deployed by pivoting about the mounting member.

18. A method a s claimed in claim 16, wherein the apparatus is deployable manually.

* * * * *

UNITED STATES PATENT AND TRADEMARK OFFICE

CERTIFICATE OF CORRECTION

PATENT NO. : 7,322,430 B2
APPLICATION NO. : 10/492742
DATED : January 29, 2008
INVENTOR(S) : Keith Littlely It is certified that error appears in the above-identified patent and that said Letters Patent is hereby corrected as shown below:

On the Title page, please replace Field 74 Attorney, Agent, or Firm "Madison & Austin" with --Madson & Austin--.

In column 10, line 2, please replace "said at least one member: and" with --said at least one member; and--.

Signed and Sealed this

Twentieth Day of May, 2008

JON W. DUDAS
*Director of the United States Patent and Trademark Office*